US006378425B1

(12) United States Patent
Stephan

(10) Patent No.: US 6,378,425 B1
(45) **Date of Patent: *Apr. 30, 2002**

(54) SHEET-GUIDING DEVICE FOR PRINTING PRESSES

(75) Inventor: Günter Stephan, Wiesloch (DE)

(73) Assignee: Heidelberger Druckmaschinen AG, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/096,978

(22) Filed: Jun. 12, 1998

Related U.S. Application Data

(63) Continuation-in-part of application No. 08/857,133, filed on May 15, 1997, now Pat. No. 5,816,155, which is a continuation of application No. 08/595,103, filed on Feb. 1, 1996, now abandoned.

(30) Foreign Application Priority Data

Feb. 1, 1995 (DE) ..... 195 03 110

(51) Int. Cl.[7] ..... B41F 13/24
(52) U.S. Cl. ..... 101/232
(58) Field of Search ..... 101/232, 233, 101/416.1, 419; 271/195, 194

(56) References Cited

U.S. PATENT DOCUMENTS

| | | | | |
|---|---|---|---|---|
| 3,622,058 A | | 11/1971 | Vits | 226/7 |
| 3,684,081 A | | 8/1972 | Matsuo | 198/811 |
| 4,029,009 A | | 6/1977 | Kühn et al. | 101/231 |
| 4,099,463 A | | 7/1978 | Zimmermann et al. | 101/230 |
| 4,572,071 A | | 2/1986 | Cappel et al. | 101/183 |
| 5,102,118 A | * | 4/1992 | Vits | 271/195 |
| 5,243,909 A | | 9/1993 | DeMoore et al. | 101/420 |
| 5,263,415 A | * | 11/1993 | Pollich | 101/232 |
| 5,411,251 A | * | 5/1995 | Schmid et al. | 271/195 |
| 5,419,256 A | | 5/1995 | Pollich | 101/485 |
| 5,488,905 A | | 2/1996 | Secor | 101/142 |
| 5,497,987 A | | 3/1996 | Henn et al. | 271/204 |
| 5,509,352 A | | 4/1996 | Kowalewski et al. | 101/232 |
| 5,540,152 A | * | 7/1996 | DeMoore | 101/483 |
| 5,546,858 A | | 8/1996 | Stephan | 101/420 |
| 5,655,449 A | * | 8/1997 | Henn et al. | 101/424.1 |
| 5,706,726 A | * | 1/1998 | Stephan | 101/232 |
| 5,797,327 A | * | 8/1998 | Gieser et al. | 101/483 |
| 5,868,386 A | * | 2/1999 | Stiel et al. | 101/416.1 |

FOREIGN PATENT DOCUMENTS

| | | | |
|---|---|---|---|
| DE | 34 11 029 C2 | 10/1985 | |
| DE | 42 09 067 A1 | 9/1994 | |
| GB | 2190364 | * 11/1987 | 101/232 |

* cited by examiner

*Primary Examiner*—John S. Hilten
*Assistant Examiner*—Anthony H. Nguyen
(74) *Attorney, Agent, or Firm*—Herbert L. Lerner; Laurence A. Greenberg; Werner H. Stemer

(57) ABSTRACT

A sheet guiding device for a printing press, includes guide surface members having slit nozzles for emitting blast air. The slit nozzles are aimed in a direction crosswise to a sheet travel path for tautening sheets traveling in the printing operation.

9 Claims, 4 Drawing Sheets

SHEET-GUIDING DEVICE FOR PRINTING PRESSES

CROSS-REFERENCE TO RELATED APPLICATION

This application is a Continuation-in-Part of U.S. application Ser. No. 08/857,133, filed May 15, 1997 now U.S. Pat. No. 5,816,155 which is a continuation of Ser. No. 08/595,103 filed Feb. 1, 1996.

BACKGROUND OF THE INVENTION

Field of the Invention

The invention relates to a sheet guiding device for printing presses having guide surface members with slit nozzles for receiving and transmitting blast air. The slit nozzles are aimed in a direction crosswise to a sheet travel path.

A sheet guiding device of this general type has become known heretofore from the published German Patent Document DE 34 11 029 C2. In this known sheet guiding device, an attempt has been made to achieve a reliable floating or suspended guidance of the sheets by using nozzles having different blowing directions. A floating sheet guidance device must be used during two-sided printing to avoid smearing of the ink along the guide faces, however, it has disadvantages. It is either difficult or not at all possible to obtain a floating guidance for unstable sheets, especially sheets with low weight or a low density (less than 100 g/m$^2$). Additional problems arise at high machine speeds due to arising centrifugal forces which make clean sheet guidance via the floating guide difficult.

SUMMARY OF THE INVENTION

It is accordingly an object of the invention to provide a sheet guiding device for printing presses which overcomes the hereinafore-mentioned disadvantages of the heretofore-known devices of this general type, and which provides a floating guiding device which can process sheets with a low weight and/or a low density (less than 100 /m$^2$).

With the foregoing and other objects in view there is provided, in accordance with the invention, a sheet guiding device for a printing press, having guide surface members with slit nozzles for emitting blast air, the slit nozzles are aimed in a direction to an outside of (crosswise to) a sheet travel path.

In accordance with an added feature of the invention, the slit nozzles have an air blowing direction and the air blowing direction is essentially perpendicular to the sheet travel path.

In accordance with another feature of the invention, the guide surface members have an area and the area is occupied by a different degree of concentration of the nozzles to suit the particular air requirement for keeping sheets taunt.

A further feature provides that the guide surface members be arrayed with a varying number of nozzles or a varying density thereof per unit area to suit or match the particular air requirement for keeping the sheets taunt. For example, it is thus possible for the entry and exit regions of the guide surface members to be provided with a greater density of nozzles per unit area or a higher degree of occupancy by nozzles in the respective area, while the guide zone(s) located between those regions have a lower nozzle density or degree of occupancy per unit area. It is also possible for the nozzle density or degree of areal occupancy to be provided greatest in the middle of the sheet travel path and to decrease toward the edge or sides thereof. This is especially expedient if the nozzles are slit nozzles directed towards the outside of the sheet travel path. Then, the corresponding air flow is generated in the middle of the sheet travel path and need merely be maintained towards the edge; that is, as many nozzles as in the middle of the sheet travel path are no longer needed.

In accordance with an additional feature of the invention, there are axial fans and/or adjustable-speed fans for supplying air to the slit nozzles. The air supply to the nozzles is preferably accomplished via the adjustable-speed fans. In this manner, in the blowing or blast mode, the floating or suspension guidance can be adjusted.

In accordance with yet another added feature of the invention, there are air supply chests for effecting a supply of air to the slit nozzles.

In accordance with yet another feature of the invention, there is an axial fan assigned to each of the air supply chests.

In accordance with another additional feature of the invention, the slit nozzles are stamped into the guide surface members.

In accordance with a concomitant feature of the invention there is a central air supply provided with blowing air for supplying air to the slit nozzles.

It is possible to have the desired air act upon relatively large nozzles individually by the fans, or an air supply can be provided wherein individual regions or portions of the air supply are made effective via air supply chests or boxes, to each of which an air supply is assigned. Naturally, a further subdivision is also possible, depending upon how strong the action of the air in a certain region is required. The advantage of the air supply chests or boxes is that many nozzles can be supplied by one air supply element. For a relatively large number of nozzles, for example, correspondingly strong axial fans can be used. Due to the subdivision, it is nevertheless possible to supply air variably to the individual regions. It is therefore proposed that an axial fan be assigned to each blower chest, and that the size of the air supply chests be adapted to the air requirement of the respective region.

Other features which are considered as characteristic for the invention are set forth in the appended claims.

Although the invention is illustrated and described herein as embodied in a sheet guiding device for printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DESCRIPTION OF THE PREFERRED EMBODIMENTS

Figure 1:
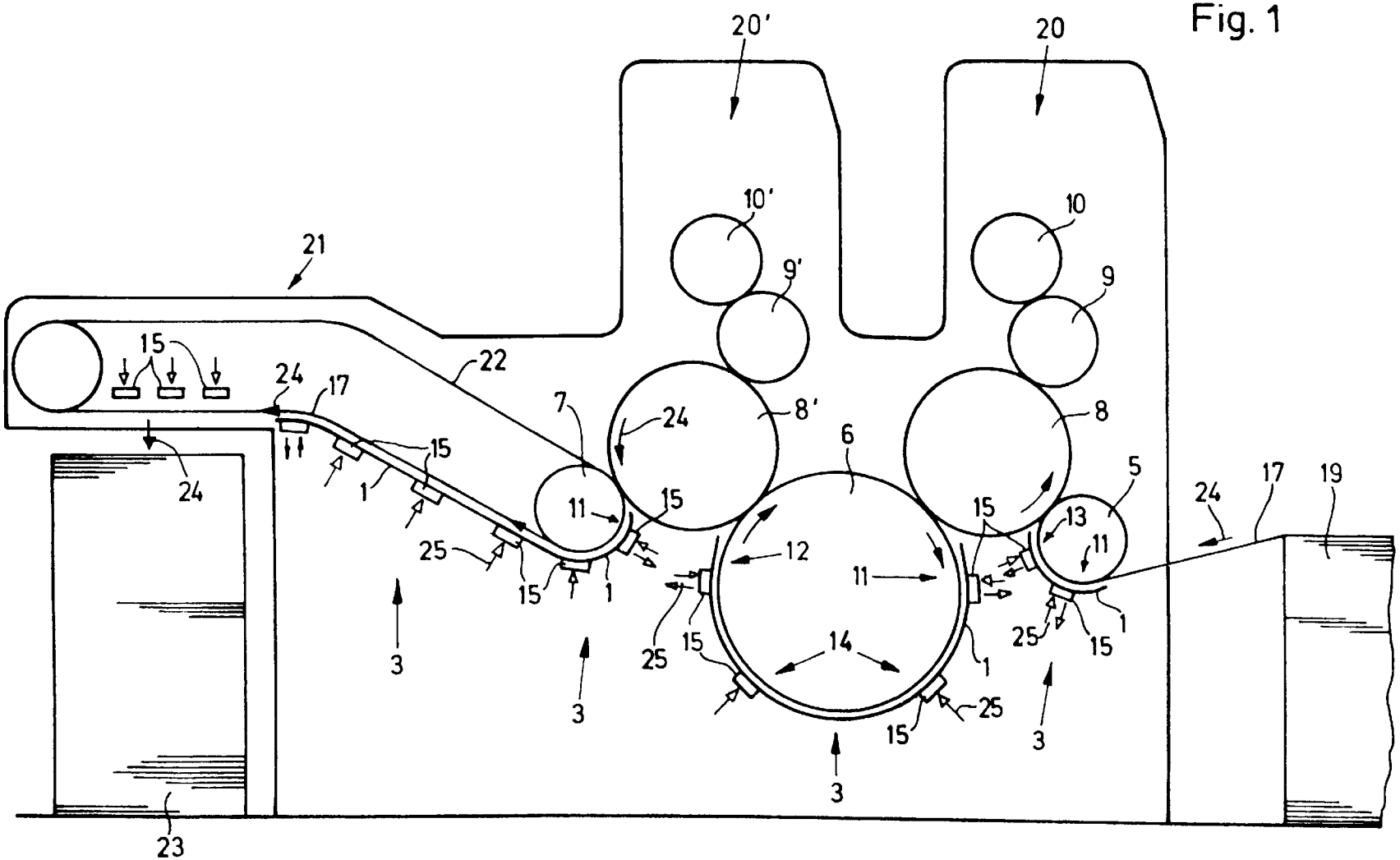
FIG. 1 is a diagrammatic side elevational view of a printing press provided with a sheet guiding device according to the invention.
Figure 2:
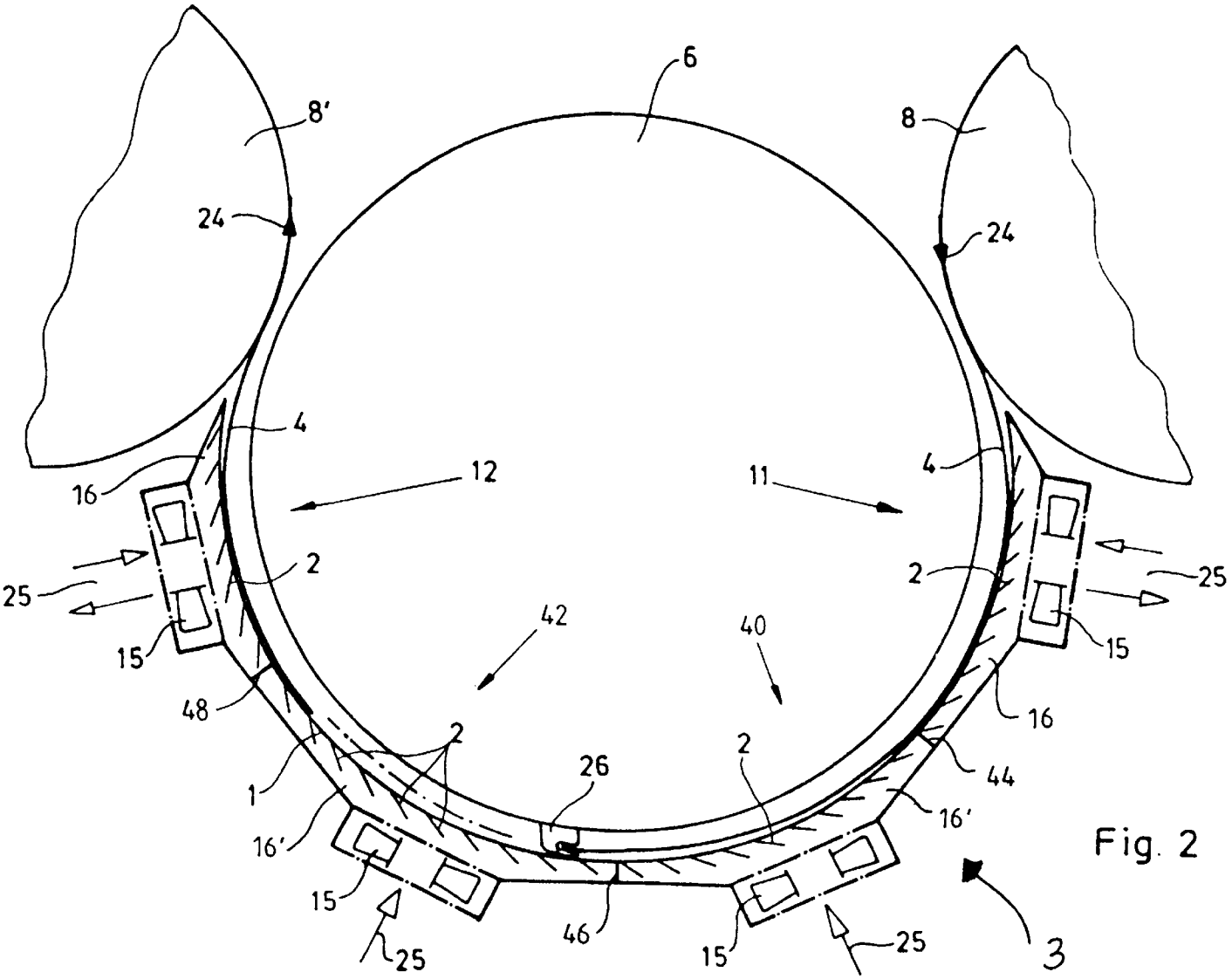
FIG. 2 is an enlarged fragmentary view of FIG. 1 showing a guide surface of a transfer drum of the printing press in accordance with the invention.

Referring now to the drawings and, first, particularly to FIG. 1 thereof, there is shown therein diagrammatically a printing press with an exemplary embodiment of a sheet guiding device according to the invention. In the interest of simplicity, only two printing units 20 and 20' of the printing press are shown; generally, such a printing press has four printing units or more. Each printing unit 20, 20' has an impression cylinder 8, 8', a rubber blanket cylinder 9, 9', and a plate cylinder 10, 10', as well as non-illustrated inking units. Between the printing units 20 and 20', a transfer drum 6 assures the further passage of the sheets 4 to be printed. If a printing press has several printing units, transfer drums 6 are always disposed between each two printing units. Naturally, it is also possible for a plurality of sheet feeding drums to be provided instead of the single transfer drum 6. In the illustrated printing press, a sheet travel path 17 is shown with accompanying arrows 24 indicating the sheet travel direction. The sheets 4 are removed from a feed pile 19 and forwarded, by a conventional non-illustrated feeder device, to a feeder drum 5 having non-illustrated grippers with which it transfers the sheets 4 to an impression cylinder 8 for printing. From the impression cylinder 8, the sheet 4 is accepted by grippers 26 (FIG. 2) of the transfer drum 6 and delivered to a further impression cylinder 8', so that a further printing operation can be performed on the sheet 4. In the illustrated printing press, the impression cylinder 8' transfers the sheet 4 to a delivery drum 7 of a delivery system 21. The delivery drum 7 is a transfer drum having gripper bars which are disposed on a delivery chain 22 and which transport the accepted sheets 4 to the end of the delivery system 21, whereat the sheets 4 are deposited on a delivery pile 23.

Additional sheet guidance is required in sections 3 of the printing press so that the sheets 4 will be transported cleanly and, above all, transferred to the impression cylinders 8 and 8' so as to lie smoothly thereon. In this regard, guide surface members or deflectors 1 having a number of preferably slitlike nozzles 2 are disposed in the sections 3. These nozzles are not shown in FIG. 1 but can be seen, for example, at the transfer drum 6 in FIG. 2. The guide surface member 1 at the transfer drum 6 has a total of four nozzle regions 11, 12, 40 and 42, divided by partitions 44, 46 and 48, and acted upon with air by a respective axial fan 15. The nozzle regions 11, 12, 40 and 42 are formed of a plurality of nozzles 2, which are disposed behind one another as seen in the viewing direction of FIG. 2. The arrows 25 indicate the possible directions in which the respective axial fans 15 blow. The sheet 4 which has been accepted or taken over by the transfer drum 6 from the impression cylinder 8 by a row of grippers 26 is transported onwardly to the impression cylinder 8'.

When the sheet guiding device is in the blowing or blast mode, the sheet 4 experiences a floating or suspension guidance wherein it is guided between the transfer drum 6 and the guide surface member 1 without contacting the surface of the guide surface member 1. Such a floating guidance is necessary in perfector printing, for example, because neither side of the sheet 4 must be allowed to become smeared at the transfer drum 6 or at the guide surface members 1.

It is believed to be apparent from FIG. 1 that the axial fans 15 are also disposed at the feeder drum 5 in the entry region 11 and the exit region 13, respectively, and can apply suction air to the nozzles 2 so as to permit taut sheet guidance there as well, and thereby ensuring that the sheet 4 lies properly on the impression cylinder 8. One of the axial fans 15 is also provided at the delivery drum 7 and assures that an end of a sheet in this region is reliably guided and cannot fall downwardly if the press should stop, which could consequently cause a creasing of the sheet 4 and render it unuseable. Further apparent is how additional axial fans 15 for sheet guidance can be disposed in the section 3 of the delivery system 21 and can serve, respectively, to feed the sheet 4 reliably to the delivery pile 23, and to assure that the sheets are acted upon with blown or blast air above the delivery pile 23 in such a manner that they are deposited quickly on the delivery pile 23.

Figure 3:
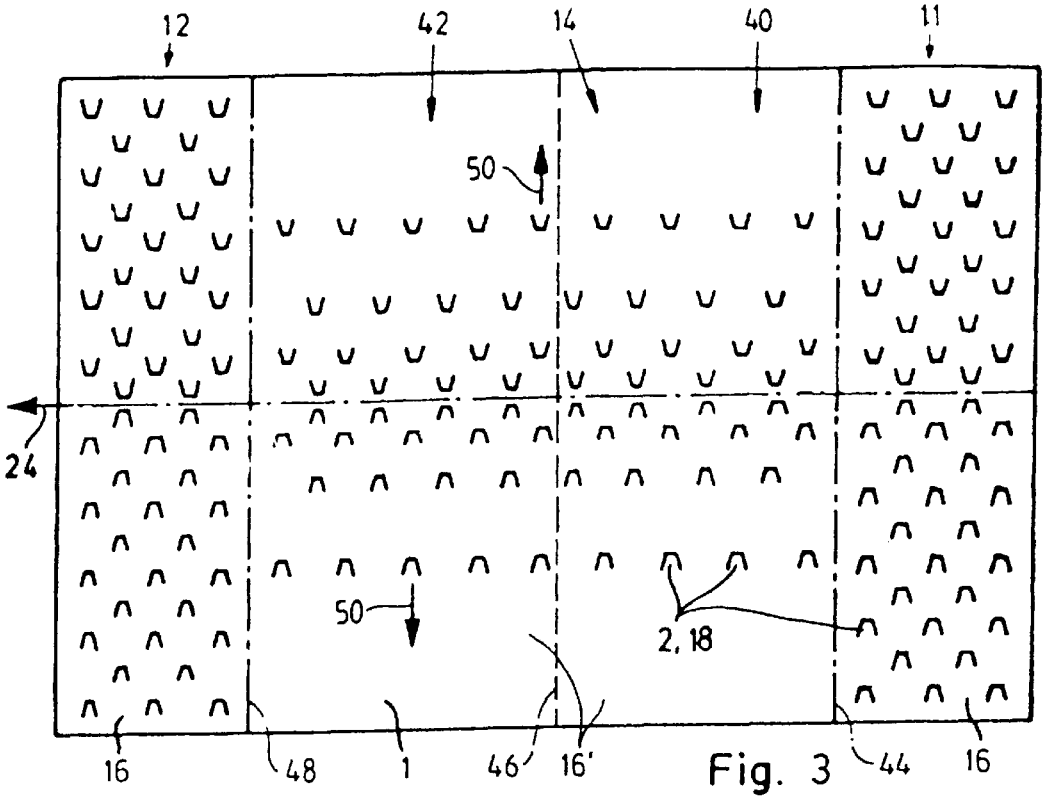
FIG. 3 is a developed top plan view of the sheet guiding device formed of air supply boxes in accordance with the invention.

FIG. 3 shows a guide surface member 1 having the nozzles 2 which are acted upon with air supplied by air supply boxes or chests 16 and 16'. The guide surface member 1 is shown in a plan view in FIG. 3, wherein the lines illustrate the subdivision of the guide surface member 1 into the various air supply boxes or chests 16 and 16'. The density per unit of surface area of the nozzles 2 which are embodied as slit nozzles 18 is varied. In the entry region 11, for example, two air supply boxes or chests 16 are provided, which have a relatively high density of nozzles 2 per unit of surface area. They are followed by a guide zone 14 having a varied density of nozzles 2 which is greater in a middle region thereof than at the edges thereof. The guide zone 14 corresponds to the nozzle regions 40 and 42, wherein an application of blown or blast air is adequate for any operating mode of the printing press. Then follows again a region, which has a higher density of nozzles, which is the exit region 12, wherein relatively strong holding or retention forces must act upon the sheet 4 in the suction-air operating mode.

Figure 4:
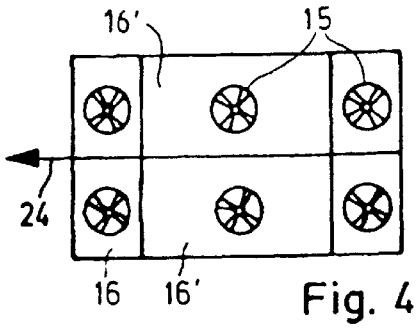
FIGS. 4, 5 and 6 are different arrangements of axial fans in the air supply boxes.
Figure 5:
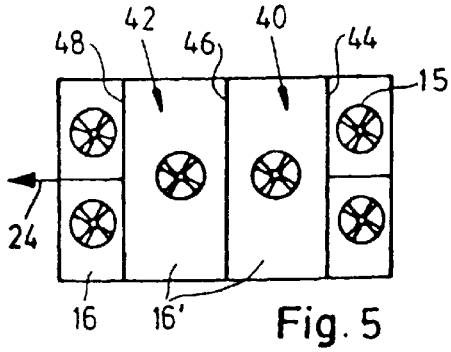

FIG. 4 shows how the axial fans 15 can be arranged with the air supply chests 16 and 16' shown in FIG. 3. It is also possible, however, to provide an arrangement of air supply chests 16 and 16' and of axial fans 15 in the manner shown in FIG. 5.

Figure 6:
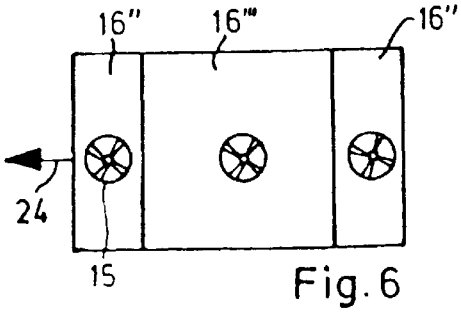
Figure 7:
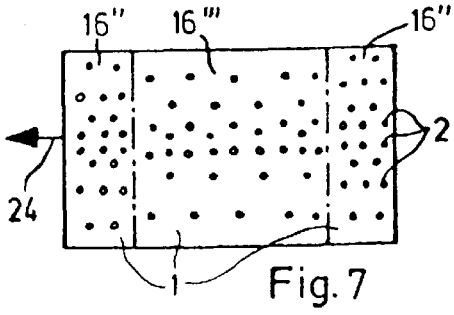
FIG. 7 is a nozzle array in the air supply boxes.

If a lesser amount of air is required, one of the subdivisions can be dispensed with, so that only one blower chest 16", respectively, is provided in the entry region 11 and in the exit region 12, and a large blower chest 16'" is provided in the guide zone 14, as shown in FIG. 6. The nozzle array is formed accordingly and is represented in FIG. 7.

Figure 8:
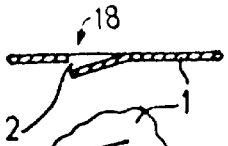
FIGS. 8 and 8*a* are respective cross-sectional and plan views of a slit nozzle in accordance with the invention.
Figure 8A:
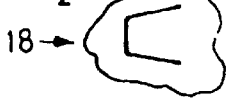
Figure 9:
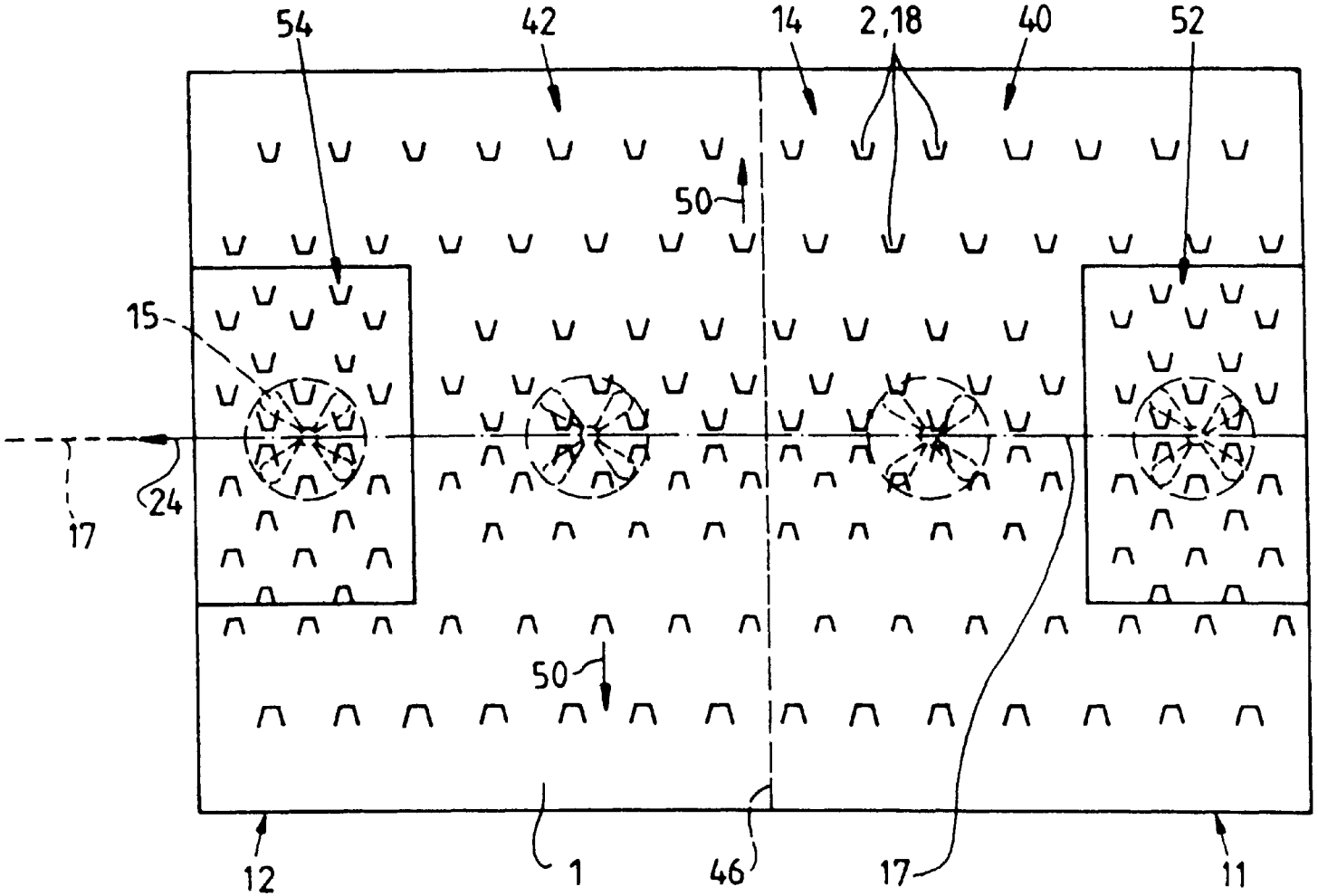
FIG. 9 is a view similar to that of FIG. 3 showing a guide surface wherein sucking of a sheet occurs in sections disposed centrally to a longitudinal axis of the sheet.

FIGS. 8 and 8*a* show the preferred embodiment of the nozzles 2 which have already been indicated in FIG. 3. This involves slit nozzles 18, which can be stamped in a relatively simple manner into the sheet metal of the guide surface members 1. In the arrangement shown in FIG. 3, the direction of blowing is directed outwardly (crosswise to the sheet travel direction) as represented by arrows, which tautens the sheet 4 transversely or crosswise to the travel direction thereof. To that end, it is necessary for two strong, outwardly directed air flows to be formed in the middle and move towards the side of the sheet 4, those air flows, as they travel towards the outside, being maintainable by using a lesser number of nozzles 2, 18.

The exemplary embodiments merely illustrate possibilities for constructing the sheet guiding device of the invention; other constructions with different nozzle arrays and, if necessary or desirable, other blowing or blast directions are also conceivable within the scope of the invention. Instead of the axial fans 15, a central air supply with blown or blast air and suction air or different types of fans may also be used.

I claim:

1. A sheet guiding device for a printing press, comprising:

a guide surface members having edges that are parallel to a sheet travel direction, said surface having slit nozzles for emitting two outwardly directed blast air flows, said slit nozzles aimed in a direction toward said edges and having an air blowing direction substantially perpendicular to the sheet travel path.

2. The sheet guiding device according to claim 1, wherein said guide surface members have an area and said area is occupied by a different degree of concentration of said nozzles to suit the particular air requirement for keeping sheets taut.

3. The sheet guiding device according to claim 2, wherein the degree of the concentration of said slit nozzles is greatest in a middle of the sheet travel path and decreases toward the edges of the sheet travel path.

4. The sheet guiding device according to claim 1, including axial fans for supplying air to said slit nozzles.

5. The sheet guiding device according to claim 1, including adjustable-speed fans for supplying air to said slit nozzles.

6. The sheet guiding device according to claim 1, including air supply chests for effecting a supply of air to said slit nozzles.

7. The sheet guiding device according to claim 6, including an axial fan assigned to each of said air supply chests.

8. The sheet guiding device according to claim 1, wherein said slit nozzles are stamped into said guide surface members.

9. The sheet guiding device according to claim 1, including a central air supply provided with blowing air for supplying air to said slit nozzles.

* * * * *

UNITED STATES PATENT AND TRADEMARK OFFICE

CERTIFICATE OF CORRECTION

PATENT NO. : 6,378,425 B1
DATED : April 30, 2002
INVENTOR(S) : Günter Stephan

It is certified that error appears in the above-identified patent and that said Letters Patent is hereby corrected as shown below:

Column 5,
Line 8, should read as follows:
guide surface members having edges that are parallel to Signed and Sealed this Third Day of May, 2005

JON W. DUDAS
*Director of the United States Patent and Trademark Office*